US009207564B2

(12) United States Patent
Wakamatsu et al.

(10) Patent No.: US 9,207,564 B2
(45) Date of Patent: Dec. 8, 2015

(54) IMAGE FORMING APPARATUS

(71) Applicant: Brother Kogyo Kabushiki Kaisha, Nagoya-shi, Aichi-ken (JP)

(72) Inventors: Mayu Wakamatsu, Tsushima (JP); Masatoshi Shiraki, Nagoya (JP); Daisuke Ishizuka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/525,557

(22) Filed: Oct. 28, 2014

(65) Prior Publication Data

US 2015/0117882 A1 Apr. 30, 2015

(30) Foreign Application Priority Data

Oct. 28, 2013 (JP) ..... 2013-223203

(51) Int. Cl.
*G03G 15/06* (2006.01)
*G03G 21/00* (2006.01)

(52) U.S. Cl.
CPC ..... *G03G 15/065* (2013.01); *G03G 21/0058* (2013.01)

(58) Field of Classification Search
CPC combination set(s) only.
See application file for complete search history.

(56) References Cited

U.S. PATENT DOCUMENTS

2001/0026694 A1* 10/2001 Sakaizawa et al. ..... 399/50
2010/0260511 A1* 10/2010 Kojima et al. ..... 399/46
2013/0108289 A1 5/2013 Tamura

FOREIGN PATENT DOCUMENTS

JP H09-197841 A 7/1997
JP 2013-097128 A 5/2013

* cited by examiner

*Primary Examiner* — Clayton E Laballe
*Assistant Examiner* — Jas Sanghera
(74) *Attorney, Agent, or Firm* — Banner & Witcoff, Ltd.

(57) ABSTRACT

An image forming apparatus includes an image carrier, a holding roller which holds thereon developer attached on the image carrier, a transfer member which transfers a developer image on the image carrier to a transfer medium, a collection device which collects the developer on the holding roller via the image carrier, and a control device which executes a collection control of causing the developer held on the holding roller to move to the image carrier such that the collection device collects the developer via the image carrier. The control device applies to the holding roller a first discharge bias having a polarity same as the developer after the collection control starts until a first time elapses and thereafter applies to the holding roller a second discharge bias having a polarity same as the developer and having an absolute value larger than the first discharge bias.

19 Claims, 8 Drawing Sheets

IMAGE FORMING APPARATUS

CROSS-REFERENCE TO RELATED APPLICATION

This application claims priority from Japanese Patent Application No. 2013-223203, filed on Oct. 28, 2013, the entire subject matter of which is incorporated herein by reference.

TECHNICAL FIELD

The present invention relates to an image forming apparatus configured to execute a collection control for collecting developer on a holding roller into a collection device via at least an image carrier.

BACKGROUND

There has been known an image forming apparatus which includes a photosensitive drum configured to form an electrostatic latent image thereon, a developing device configured to supply toner to the electrostatic latent image on the photosensitive drum and to form a toner image on the photosensitive drum, a transfer roller configured to transfer the toner image on the photosensitive drum to a sheet, and a cleaning roller configured to collect the toner remaining on the photosensitive drum without being transferred to the sheet (refer to JP-A-H9-197841). This image forming apparatus executes a holding control of applying to the cleaning roller a constant holding bias having an opposite polarity to the toner such that the cleaning roller collects and holds thereon the toner on the photosensitive drum, and a collection control of applying to the cleaning roller a constant discharge bias having the same polarity as the toner such that the toner on the cleaning roller is discharged to the photosensitive drum and the developing device collects the toner via the photosensitive drum.

However, in this image forming apparatus, since the discharge bias is set to be constant, when a relatively large amount of toner is held on the cleaning roller, a discharge amount of the toner is large at the first one rotation of the cleaning roller from a time at which the collection control starts, and the discharge amount of the toner gradually decreases thereafter. That is, a density difference of the discharged toners would become larger. In this case, the developing device may not be able to favorably collect the toner having the large density difference on the photosensitive drum unless the developing device is designed to cope with the phenomenon.

SUMMARY

Accordingly, it is an aspect of the present invention to provide an image forming apparatus capable of favorably collecting developer discharged from a holding roller such as a cleaning roller into a collection device such as a developing device.

According to an illustrative embodiment of the present invention, there is provided an image forming apparatus including an image carrier configured to carry thereon a developer image, a holding roller configured to hold thereon developer attached on the image carrier, a transfer member provided to face the image carrier and configured to transfer the developer image on the image carrier to a transfer medium, a collection device configured to collect the developer on the holding roller via at least the image carrier, and a control device configured to execute a holding control of applying to the holding roller a holding bias having a polarity opposite to the developer such that the holding roller holds the developer, and a collection control of causing the developer held on the holding roller to move to the image carrier such that the collection device collects the developer via at least the image carrier. The control device is further configured to apply to the holding roller a first discharge bias having a polarity same as the developer after the collection control starts until a first time elapses, the first time corresponding to a time which is equal to or longer than a time necessary for the holding roller to rotate one rotation and which is equal to or shorter than a time necessary for the holding roller to rotate three rotations, and apply to the holding roller a second discharge bias having a polarity same as the developer and having an absolute value larger than the first discharge bias after the first time elapses from a start of the collection control.

According to another illustrative embodiment of the present invention, there is provided an image forming apparatus including an image carrier configured to carry thereon a developer image, a holding roller configured to hold thereon developer attached on the image carrier, and a control device configured to execute a holding control of applying to the holding roller a holding bias having a polarity opposite to the developer such that the holding roller holds the developer, and a discharge control of causing the developer held on the holding roller to move to the image carrier. The control device is further configured to: apply to the holding roller a first discharge bias having a polarity same as the developer after the discharge control starts until a first time elapses, the first time being equal to or longer than a time necessary for the holding roller to rotate one rotation, and apply to the holding roller a second discharge bias having a polarity same as the developer and having an absolute value larger than the first discharge bias after the first time elapses from a start of the discharge control.

According to another illustrative embodiment of the present invention, there is provided a control method for an image forming apparatus including an image carrier configured to carry thereon a developer image, and a holding roller configured to hold thereon developer attached on the image carrier. The control method includes executing a holding control of applying to the holding roller a holding bias having a polarity opposite to the developer such that the holding roller holds the developer; and executing a discharge control of causing the developer held on the holding roller to move to the image carrier. The discharge control includes: applying to the holding roller a first discharge bias having a polarity same as the developer after the discharge control starts until a first time elapses, the first time being equal to or longer than a time necessary for the holding roller to rotate one rotation; and applying to the holding roller a second discharge bias having a polarity same as the developer and having an absolute value larger than the first discharge bias after the first time elapses from a start of the discharge control.

According to the above configuration, it is possible to favorably collect the developer discharged from the holding roller into the collection device.

BRIEF DESCRIPTION OF THE DRAWINGS

The above and other aspects of the present invention will become more apparent and more readily appreciated from the following description of illustrative embodiments of the present invention taken in conjunction with the attached drawings.

DETAILED DESCRIPTION

Hereinafter, an illustrative embodiment of the present invention will be described in detail with reference to the drawings. In the below descriptions, the directions are described on the basis of a user who uses a color printer (an example of an image forming apparatus). That is, the left of FIG. 1 is referred to as the 'front side,' the right of FIG. 1 is referred to as the 'rear side,' the back side of FIG. 1 is referred to as the 'left side' and the front side of FIG. 1 is referred to as the 'right side.' Also, the upper and lower directions of FIG. 1 are referred to as the 'upper-lower direction.'

Figure 1:
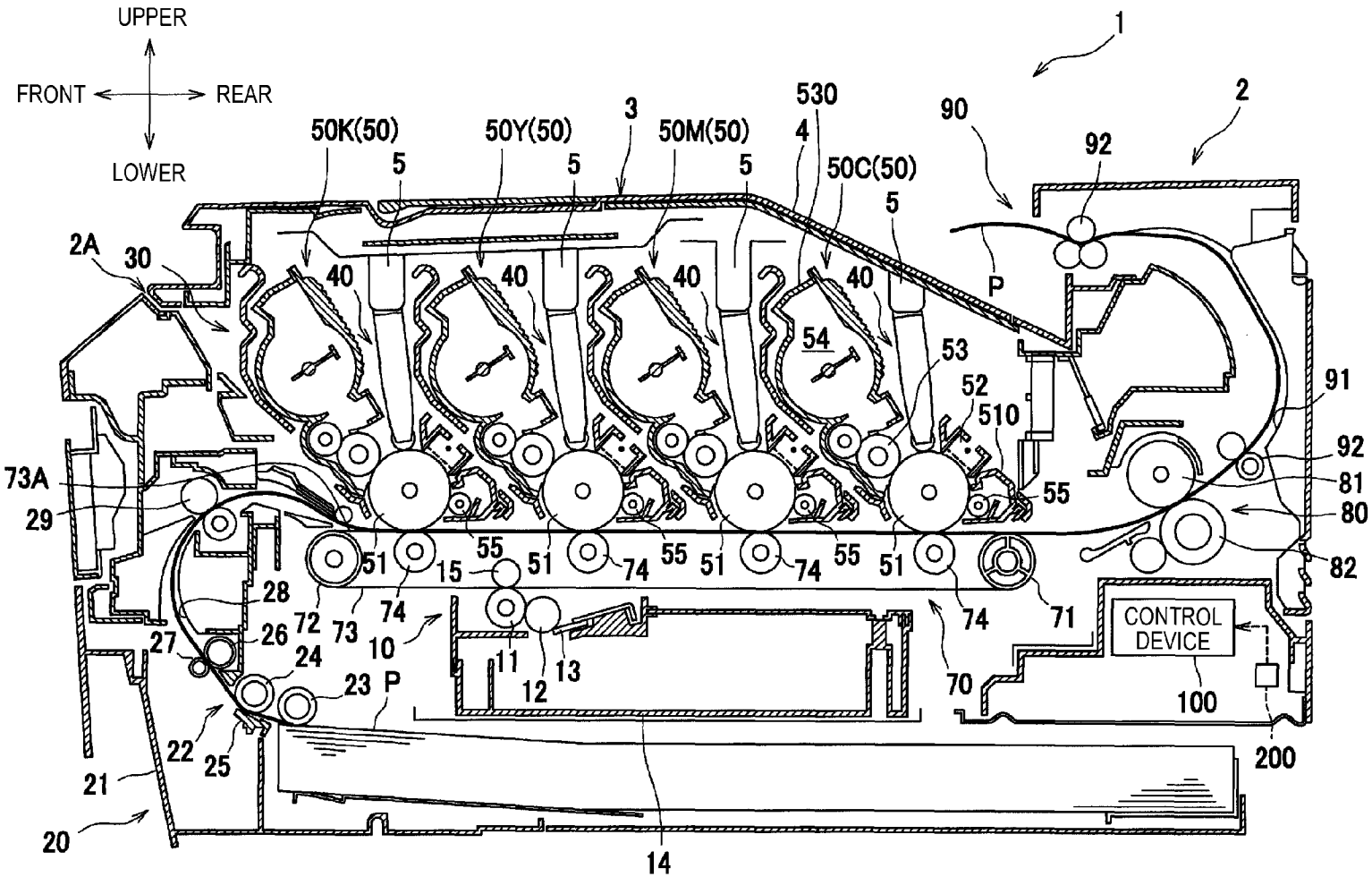
FIG. 1 is a sectional view showing a color printer according to an illustrative embodiment of the present invention.

As shown in FIG. 1, a color printer 1 has, in an apparatus main body 2, a feeder unit 20 configured to feed a sheet P (an example of a recording medium), an image forming unit 30 configured to form an image on the fed sheet P, a sheet discharge unit 90 configured to discharge the sheet P having an image formed thereon, and a control device 100.

The apparatus main body 2 is formed at its upper part with an opening 2A. The opening 2A is opened and closed by an upper cover 3 rotatably supported to the apparatus main body 2. An upper surface of the upper cover 3 is a sheet discharge tray 4 on which the sheet P discharged from the apparatus main body 2 is accumulated, and a lower surface thereof is provided with a plurality of LED attaching members 5 configured to hold LED units 40.

The feeder unit 20 is provided at a lower part in the apparatus main body 2 and includes a sheet feeding tray 21 detachably mounted to the apparatus main body 2 and a sheet feeding mechanism 22 configured to convey the sheet P from the sheet feeding tray 21 towards the image forming unit 30. The sheet feeding mechanism 22 is provided in front of the sheet feeding tray 21 and includes a sheet feeding roller 23, a separation roller 24, a separation pad 25, a sheet dust collection roller 26, a pinch roller 27 and a registration roller 29.

In the feeder unit 20, the sheets P fed from the sheet feeding tray 21 by the sheet feeding roller 23 are separated by the separation roller 24 and the separation pad 25 one by one, which is then conveyed to the upper, and the sheet dusts are removed while the sheet passes between the sheet dust collection roller 26 and the pinch roller 27. After that, the direction of the sheet P is changed through a conveyance path 28 to direct rearward, the skew of the sheet P is corrected by the registration rollers 29, and then, the sheet P is fed to the image forming unit 30.

The image forming unit 30 has four LED units 40, four process cartridges 50, a transfer unit 70, a cleaning device 10 (an example of a collection device), and a fixing device 80.

The LED unit 40 is swingably coupled to the LED attaching member 5 and is appropriately positioned and supported by a positioning member provided for the apparatus main body 2.

The process cartridges 50 are arranged side by side in the front-rear direction between the upper cover 3 and the feeder unit 20, and have a drum cartridge 510 and a developing cartridge 530 (an example of a developing device), respectively. The drum cartridge 510 has a photosensitive drum 51 (an example of an image carrier), a charger 52 and a cleaning roller 55 (an example of a holding roller). The developing cartridge 530 is detachably mounted to the drum cartridge 510 and has a developing roller 53 and a toner accommodation chamber 54 configured to accommodate therein toner (an example of developer).

The process cartridges 50 are arranged side by side from an upstream side of a conveyance direction (a moving direction of a belt surface) of the sheet P in order of the process cartridges 50K, 50Y, 50M, 50C in which black, yellow, magenta and cyan toners are respectively accommodated. Meanwhile, in the specification and drawings, when specifying the photosensitive drum 51, the developing roller 53, the cleaning roller 55 and the like corresponding to the color of the toner, the reference signs K, Y, M, C are respectively attached in correspondence to black, yellow, magenta and cyan.

The photosensitive drums 51 are respectively provided for the plurality of drum cartridges 510 and are arranged side by side in the front-rear direction.

The developing roller 53 is configured to contact the photosensitive drum 51 and to supply the toner to an electrostatic latent image on the photosensitive drum 51. Incidentally, in this illustrative embodiment, when supplying the toner from the developing roller 53 to the photosensitive drum 51, the toner is sliding-contacted between the developing roller 53 and a supply roller (a reference numeral thereof is omitted), so that the toner is positively charged.

Figure 2:
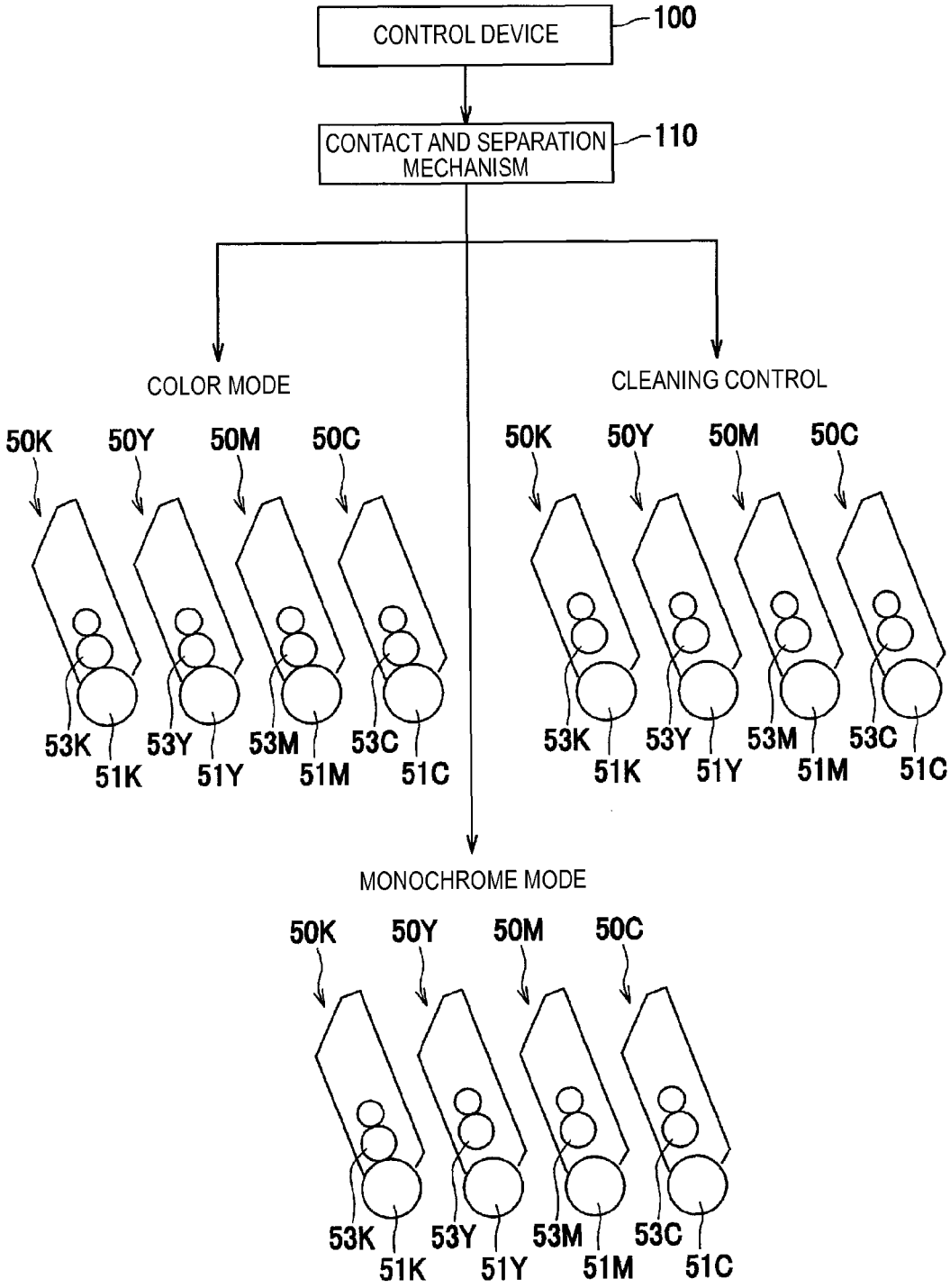
FIG. 2 shows separation states between photosensitive drums and developing rollers.

As shown in FIG. 2, the developing roller 53 is caused to come close to and to separate from the photosensitive drum 51 by controlling a contact and separation mechanism 110 with the control device 100. Specifically, in a color mode, all the developing rollers 53K, 53Y, 53M, 53C are contacted to the corresponding photosensitive drums 51K, 51Y, 51M, 51C to supply the toners to the respective photosensitive drums 51K, 51Y, 51M, 51C. In a monochrome mode, only the developing roller 53K for black (for monochrome) is contacted to the photosensitive drum 51K, and the other developing rollers 53Y, 53M, 53C are separated from the corresponding photosensitive drums 51Y, 51M, 51C. Further, in a collection control (cleaning control) which will be described later, all the developing rollers 53K, 53Y, 53M, 53C are separated from the corresponding photosensitive drums 51K, 51Y, 51M, 51C.

As shown in FIG. 1, the plurality of cleaning rollers 55 are provided in the vicinity of the respective photosensitive drums 51 so as to correspond to the respective photosensitive drums 51. The cleaning roller 55 is configured so that a holding bias having an opposite polarity to the toner is applied thereto and the toner attached on the photosensitive drum 51 can be thus temporarily held with the cleaning roller 55. Also, the cleaning roller 55 is configured so that a discharge bias having the same polarity as the toner is applied thereto and the toner held by the cleaning roller 55 can be thus discharged (moved) to the photosensitive drum 51.

The transfer unit 70 is provided between the feeder unit 20 and the respective process cartridges 50, and has a driving roller 71, a driven roller 72, a conveyance belt 73 and transfer rollers 74 (an example of a transfer member).

The driving roller 71 and the driven roller 72 are arranged in parallel with being spaced from each other in the front-rear direction, and the conveyance belt 73 configured by an endless belt is wound around the driving roller 71 and the driven roller 72. The conveyance belt 73 has, as an outer surface, a belt surface 73A (facing surface) configured to face and contact the respective photosensitive drums 51, and is configured to rotate by the driving roller 71 so that the belt surface 73A moves along the arrangement direction of the respective photosensitive drums 51. Also, the four transfer rollers 74 configured to interpose the conveyance belt 73 between the respective photosensitive drums 51 and the transfer rollers 74 are arranged to face the respective photosensitive drums 51 at an inner side of the conveyance belt 73. A transfer bias is applied to the transfer rollers 74 at the transfer by a constant current control.

The cleaning device 10 is configured to sliding-contact the conveyance belt 73 and to collect the toner and the like attached on the conveyance belt 73 and is arranged to face the conveyance belt 73 at the lower of the conveyance belt 73. Specifically, the cleaning device 10 is configured to collect the toner on the cleaning rollers 55 via the photosensitive drums 51 and the conveyance belt 73. Specifically, the cleaning device 10 has a sliding-contact roller 11, a collection roller 12, a blade 13 and a waste toner chamber 14.

The sliding-contact roller 11 is arranged to contact an outer periphery of the conveyance belt 73 and is configured to collect the attachments on the conveyance belt 73 while a collection bias is applied between the sliding-contact roller 11 and a backup roller 15 arranged on an inner periphery of the conveyance belt 73.

The collection roller 12 is configured to sliding-contact the sliding-contact roller 11, and is configured to collect the attachments attached on the sliding-contact roller 11. The attachments on the collection roller 12 are scraped by the blade 13 arranged to sliding-contact the collection roller 12 and are collected into the waste toner chamber 14.

The fixing unit 80 is arranged at the rear side of the respective process cartridges 50 and the transfer unit 70, and has a heating roller 81 and a pressing roller 82 arranged to face the heating roller 81 and configured to press the heating roller 81.

In the image forming unit 30 configured as described above, the surface of each photosensitive drum 51 is uniformly positively charged by the charger 52 and is then exposed by each LED unit 40, in the color mode. Thereby, a potential of the exposed part are lowered, so that an electrostatic latent image based on image data is formed on each photosensitive drum 51. After that, the positively-charged toner is supplied to the electrostatic latent image from the developing roller 53, so that a toner image is carried on the photosensitive drum 51.

Then, the sheet P fed onto the conveyance belt 73 passes between the respective photosensitive drums 51 and the respective transfer rollers 74 arranged at the inner side of the conveyance belt 73, so that the toner images formed on the respective photosensitive drums 51 are transferred onto the sheet P. Then, the sheet P passes between the heating roller 81 and the pressing roller 82, so that the toner images transferred on the sheet P are heat-fixed.

The sheet discharge unit 90 has a sheet discharge conveyance path 91 extending upwardly from an exit of the fixing device 80 and formed to reverse forwards, and a plurality of pairs of conveyance rollers 92 configured to convey the sheet P. The sheet P having the toner images transferred and heat-fixed thereon is conveyed along the sheet discharge conveyance path 91 and is discharged to the outside of the apparatus main body 10 by the conveyance rollers 92, so that the sheet is accumulated on the sheet discharge tray 4.

In the below, the control device 100 is described in detail.

The control device 100 has a CPU (Central Processing Unit), a ROM (Read Only Memory), a RAM (Random Access Memory) and the like, and is configured to receive a printing command and to control the feeder unit 20, the image forming unit 30, the sheet discharge unit 90 and the contact and separation mechanism 110 based on a program stored in advance. In the meantime, the apparatus main body 2 is provided with a humidity detector 200 configured to detect humidity, and the humidity detected by the humidity detector 200 is output to the control device 100.

Specifically, the control device 100 is configured to execute a holding control of applying a negative holding bias to the cleaning rollers 55 such that the cleaning rollers 55 hold the toners thereon, and a collection control of applying a positive discharge bias to the cleaning rollers 55 such that the developer held on the cleaning rollers 55 is moved to the photosensitive drums 51 and cleaning device 10 collects developer via the photosensitive drums 51 and the conveyance belt 73.

Figure 3A:
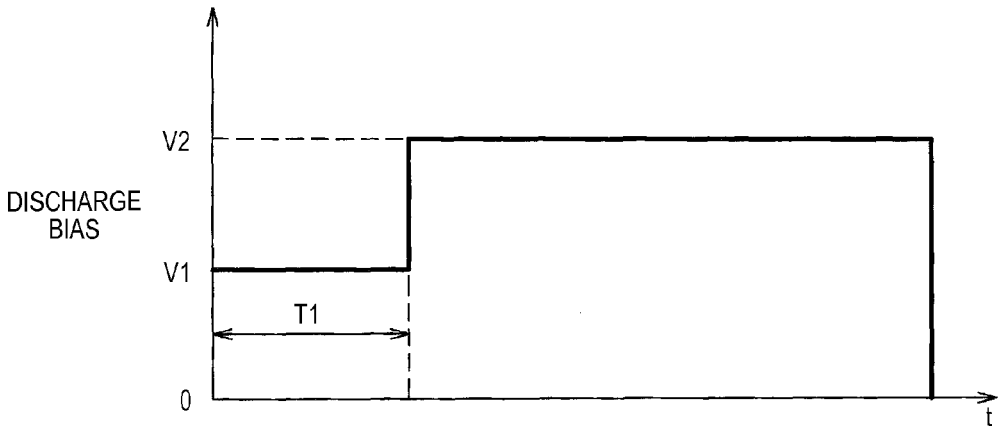
FIG. 3A shows a discharge bias in a first collection control.
Figure 3B:
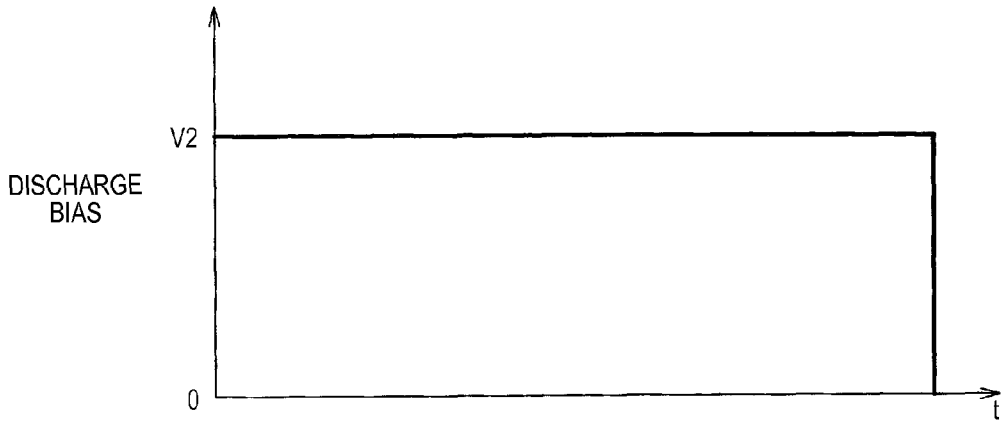
FIG. 3B shows the discharge bias in a second collection control.

The control device 100 is configured to change the discharge bias in the collection control according to a condition such as humidity. Specifically, the control device 100 is configured to execute a first collection control for controlling the discharge bias as shown in FIG. 3A, and a second collection control for controlling the discharge bias as shown in FIG. 3B, according to a condition such as humidity.

In the first collection control, the control device 100 is configured to set the discharge bias to a first discharge bias V1 after the collection control starts until a first time T1 corresponding to a time necessary for the cleaning roller 55 to rotate one rotation elapses, and to set the discharge bias to a second discharge bias V2 having an absolute value larger than the first discharge bias V1 until the collection control is finished after the first time T1 elapses from the start of the collection control. In the second collection control, the control device 100 is configured to set the discharge bias to the second discharge bias V2 after the collection control starts until the collection control is finished.

The control device 100 is configured to apply the discharge bias to the plurality of cleaning rollers 55 at the same time at the start of the collection control.

Figure 4:
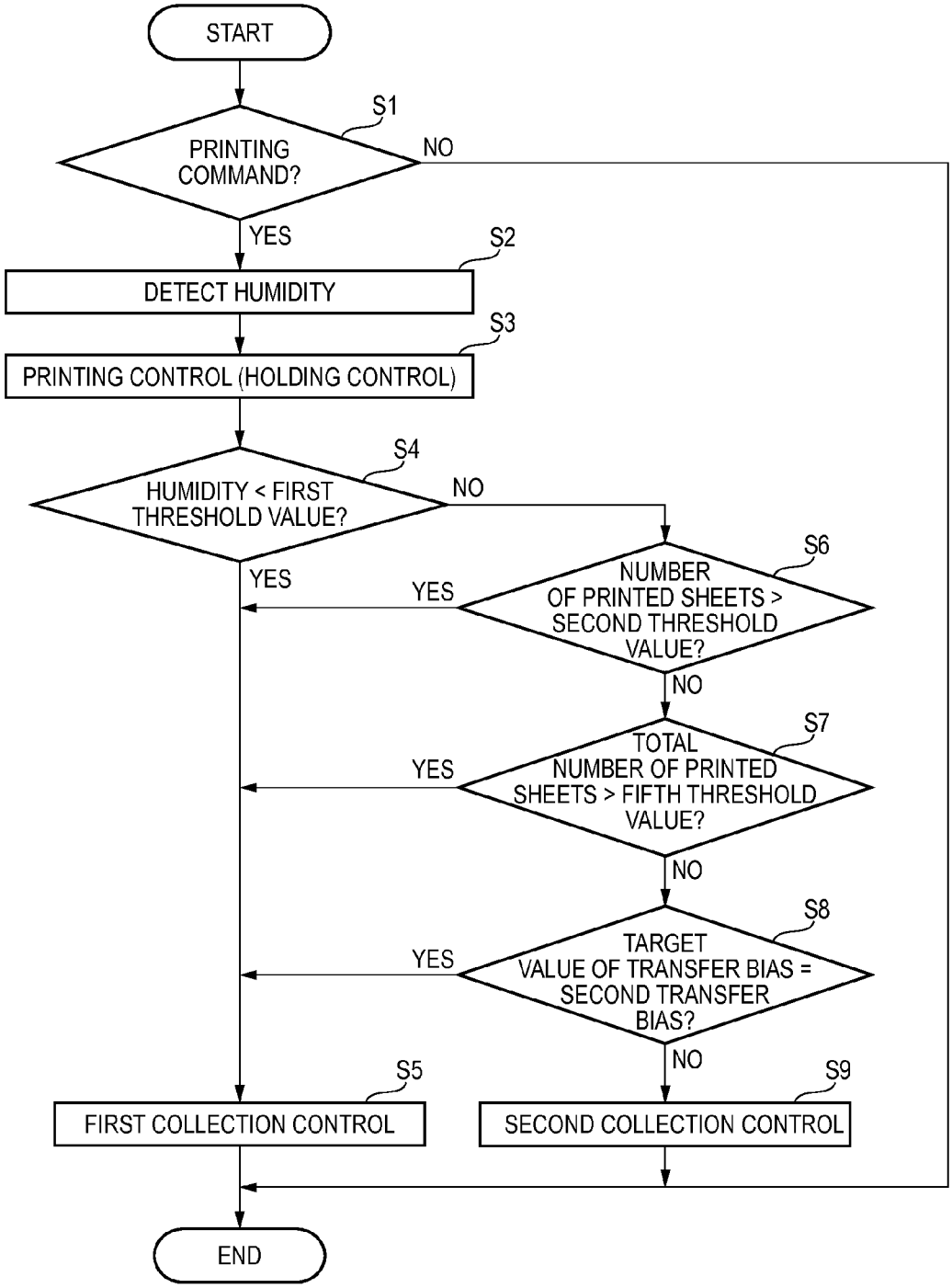
FIG. 4 is a flowchart showing an operation of a control device.

More specifically, the control device 100 is configured to execute the control in accordance with a flowchart of FIG. 4.

As shown in FIG. 4, the control device 100 determines whether a printing command is received (S1). When it is determined that a printing command is not received, the control device 100 finishes this control. When it is determined that a printing command is received (Yes), the control device 100 receives the humidity from the humidity detector 200 (S2). After step S2, the control device 100 executes the printing control and the holding control (S3).

Specifically, the control device 100 executes a control of light emission of the respective LED units 40 based on image data of the printing command, a control on the bias to be applied to the respective photosensitive drums 51 and the respective transfer rollers 74, a control of supplying current to the heating roller 81 of the fixing device 80, a rotation control on the various rollers and conveyance belt 73 for conveying the sheet P, and the like, in the printing control. Particularly, in this illustrative embodiment, the control device 100 executes first transfer processing of setting a target value of the transfer bias to be applied to the transfer roller 74 to a first transfer bias and second transfer processing of setting the target value of the transfer bias to a second transfer bias having an absolute value larger than the first transfer bias. Specifically, the control device 100 executes the first transfer processing when a type of the sheet P designated in the printing command is a normal sheet having a predetermined thickness, and executes the second transfer processing when a type of the sheet P designated in the printing command is a cardboard having a larger thickness than the predetermined thickness.

Also, the control device 100 is configured to execute the holding control of applying the negative holding bias to the cleaning rollers 55 to collect and hold the toners (hereinafter, referred to as 'transfer remaining toners') remaining on the photosensitive drums 51 without being transferred to the sheet P from the photosensitive drums 51 by the cleaning rollers 55, under the printing control. Specifically, the control device 100 is configured to apply the holding bias to all the cleaning rollers 55 during the printing control, irrespective of the mode (monochrome or color mode) of the printing control.

Incidentally, the control device 100 may be configured not to apply the holding bias to the three cleaning rollers 55 except for the cleaning roller 55 for black when the printing control is the monochrome mode. In this case, the control device 100 may be also configured not to apply the discharge bias to the three cleaning rollers 55 except for the cleaning roller 55 for black, in the collection control, too.

When the printing control is finished, i.e., when the printing of all the sheets P in accordance with the printing command is finished, the control device 100 proceeds to step S4 while continuing the rotation control on the various rollers and the conveyance belt 73 and the holding control. In step S4, the control device 100 determines whether the humidity detected in step S2 is less than a first threshold value. In the meantime, the first threshold value, and respective threshold values, which will be described later, can be appropriately set by a test, a simulation and the like.

When it is determined in step S4 that the humidity is less than the first threshold value, i.e., in an environment of low humidity (Yes), the control device 100 executes the first collection control as shown in FIG. 3A (S5). Here, since there are many transfer remaining toners at the environment of low humidity, the amount of the toner held on the cleaning roller 55 is also large. In this case, if the second collection control as shown in FIG. 3B is executed, an amount of the toner TN1 corresponding to one rotation, which is discharged to the photosensitive drum 51 from the cleaning roller 55 while the cleaning roller 55 first rotates one rotation, becomes larger by the second discharge bias V2, as shown in FIG. 5B. As a result, a density difference between the toner TN1 and the toner TN2 discharged after second rotation and thereafter is increased.

Figure 5A:
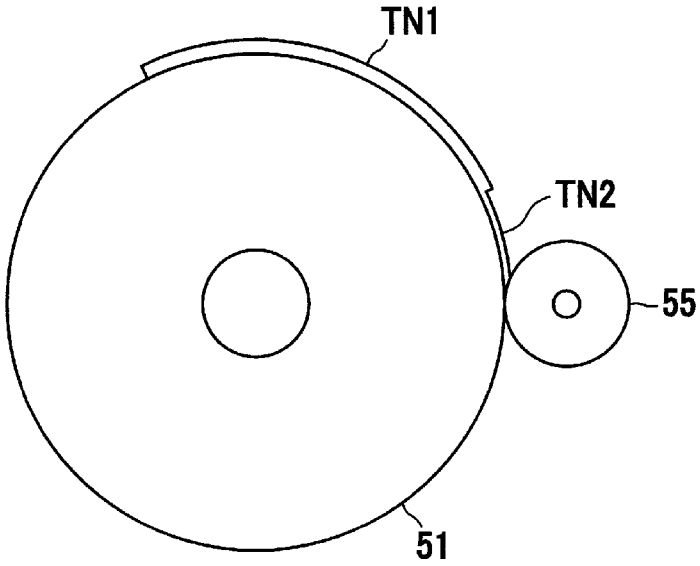
FIG. 5A shows a state of toner on a photosensitive drum when the first collection control is executed at a situation where a large amount of toner is held on a cleaning roller under a low-humidity environment.
Figure 5B:
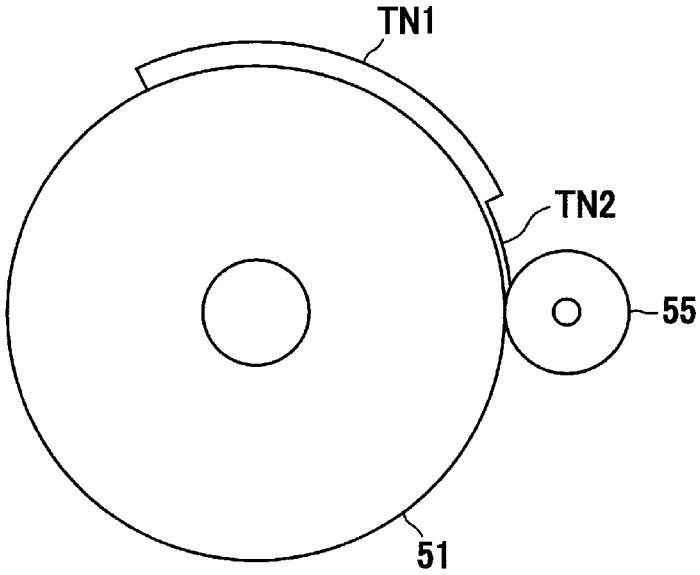
FIG. 5B shows a state of the toner on the photosensitive drum when the second collection control is executed at the situation.

In contrast, when the first collection control is executed at the environment of low humidity, like this illustrative embodiment, it is possible to suppress the amount of the toner TN1 corresponding to one rotation, which is discharged to the photosensitive drum 51 from the cleaning roller 55 while the cleaning roller 55 first rotates one rotation, by the first lower discharge bias V1, as shown in FIG. 5A. Thereby, since it is possible to reduce the density difference of the toners discharged from the cleaning roller 55 to the photosensitive drum 51, it is possible to favorably collect the toner discharged from the cleaning roller 55 into the cleaning device 10. Incidentally, after the second rotation and thereafter, the toner TN2 is not too much discharged from the cleaning roller 55 to the photosensitive drum 51. Therefore, the discharge bias is set to the second discharge bias V2 having an absolute value larger than the first discharge bias V1, so that it is possible to promptly collect the toner TN2 on the cleaning roller 55.

Figure 6:
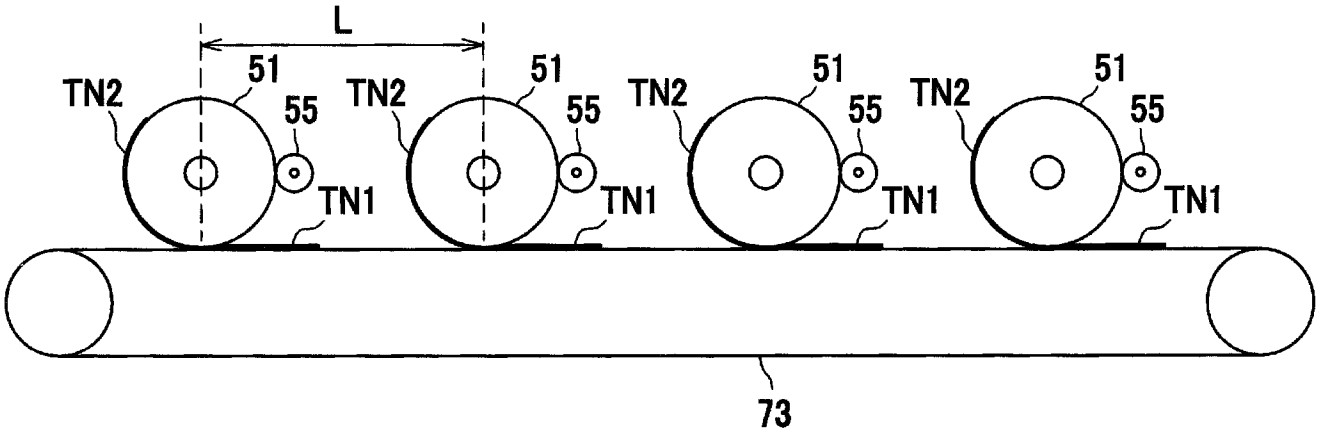
FIG. 6 shows a relation of a belt length between the adjacent photosensitive drums and toner corresponding to one rotation.

Meanwhile, in this illustrative embodiment, as shown in FIG. 6, a length L of the conveyance belt 73 between the two adjacent photosensitive drums 51 is larger than an outer circumference of the cleaning roller 55. Thereby, when the large amount of the toner TN1 corresponding to one rotation, which is discharged to the photosensitive drum 51 from the cleaning roller 55 while the cleaning roller 55 first rotates one rotation after the collection control starts, is all discharged onto the conveyance belt 73 from the photosensitive drum 51, the toner does not reach the downstream-side photosensitive drum 51. Therefore, since the upstream-side toner TN1 corresponding to one rotation and the downstream-side toner TN1 corresponding to one rotation do not overlap with each other, it is possible to suppress the density difference of the toners on the conveyance belt 73.

Returning to FIG. 4, when it is determined in step S4 that the humidity is equal to or larger than the first threshold value (No), the control device 100 determines whether the number of printed sheets designated in the printing command, i.e., the number of printed sheets in one job is larger than a second threshold value (S6). When it is determined in step S6 that the number of printed sheets is larger than the second threshold value (Yes), the control device 100 executes the first collection control (S5). Here, when the number of sheets in the job is large, an amount of toner to be consumed is also large, so that the amount of the transfer remaining toner becomes larger than a case where the number of printed sheets is small. As a result, the amount of the toner held on the cleaning roller 55 is also increased. For this reason, in this case, the first collection control is executed to reduce the density difference of the toners on the photosensitive drum 51.

When it is determined in step S6 that the number of printed sheets in the printing command is equal to or smaller than the second threshold value (No), the control device 100 determines whether a total number of printed sheets of the developing cartridge 530, i.e., a total number of sheets P printed up to now by the toner in the developing cartridge 530 after the developing cartridge 530 is mounted to the apparatus main body 2 is larger than a fifth threshold value (S7). Incidentally, the total number of printed sheets of the developing cartridge 530 is reset to 0 when the developing cartridge 530 is replaced.

Since the total number of printed sheets of the developing cartridge 530 is an index indicating a deterioration degree of the toner, the control device 100, in fact, determines in step S8 whether a deterioration degree of the toner is larger than a fourth threshold value. In the meantime, the fifth threshold value may be set to a total number of printed sheets at the time when the deterioration degree of the toner becomes the fourth threshold value, and may be appropriately set by a test, a simulation and the like.

When it is determined in step S7 that the total number of printed sheets of the developing cartridge 530 is larger than the fifth threshold value (Yes), the control device 100 executes the first collection control (S5). Here, when the total number of printed sheets of the developing cartridge 530 is large, the deterioration degree of the toner in the developing cartridge 530 is also large, so that the amount of the transfer remaining toner becomes larger than a case where the deterioration degree of the toner is small. As a result, the amount of the toner held on the cleaning roller 55 is also increased.

For this reason, in this case, the first collection control is executed to reduce the density difference of the toners on the photosensitive drum 51.

When it is determined in step S7 that the total number of printed sheets of the developing cartridge 530 is equal to or smaller than the fifth threshold value (No), the control device 100 determines whether the target value of the transfer bias in the printing control is set to the second transfer bias (S8). When it is determined in step S8 that the target value of the transfer bias is set to the second transfer bias (Yes), the control device 100 executes the first collection control (S5). Here, when the transfer bias is the second higher transfer bias, an electrical discharge is generated between the photosensitive drum 51 and the sheet P, so that an amount of the transfer remaining toner is increased. As a result, the amount of the toner held on the cleaning roller 55 is also increased. For this reason, in this case, the first collection control is executed to reduce the density difference of the toners on the photosensitive drum 51.

When it is determined in step S8 that the target value of the transfer bias is not set to the second transfer bias (No), the control device 100 executes the second collection control (S9). That is, when the humidity is equal to or larger than the first threshold value, the number of printed sheets in the printing command is equal to or smaller than the second threshold value, the total number of printed sheets of the developing cartridge 530 is equal to or smaller than the fifth threshold value and the target value of the transfer bias is the first transfer bias, the control device 100 executes the second collection control (S9). Here, when the humidity is high, when the number of printed sheets in the printing command is small, when the total number of printed sheets of the developing cartridge 530 is small and when the target value of the transfer bias is the first lower transfer bias, the amount of the transfer remaining toner is decreased, so that the amount of the toner held on the cleaning roller 55 is reduced. For this reason, in this case, even when the second collection control is executed, i.e., even when the discharge bias is set to the second discharge bias V2 from the start of the collection control, it is possible to favorably collect the toner discharged from the cleaning roller 55 during the first time T1 into the cleaning device 10. For this reason, since it is possible to promptly discharge the toner on the cleaning roller 55 to the photosensitive drum 51 by the higher discharge bias (the second discharge bias V2) from the start of the collection control, it is possible to save the time consumed to perform the collection control, as compared to a case where the discharge bias is set to the first discharge bias during the first time when the humidity is high, for example.

When the first collection control (S5) or the second collection control (S9) is finished, the control device 100 finishes this control.

According to the illustrative embodiment, following effects can be achieved in addition to the above-described effects.

That is, since the discharge bias is set to the first discharge bias V1 only for the time necessary for the cleaning roller 55 to rotate one rotation, it is possible to promptly discharge the toner on the cleaning roller 55 to the photosensitive drum 51 by the second higher discharge bias V2 after the relatively short time corresponding to one rotation elapses. Therefore, it is possible to save the time consumed to perform the collection control. Also, the moving amount of the toner on the cleaning roller 55 to the photosensitive drum 51 is largest while the cleaning roller 55 first rotates one rotation after the collection control starts. Therefore, the discharge bias is set to the first discharge bias V1 during the corresponding time period, so that it is possible to appropriately suppress the moving amount of the toner, thereby sufficiently suppressing the non-uniformity of the density.

The discharge bias is applied to the plurality of cleaning rollers 55 at the same time at the start of the collection control. Therefore, as compared to a configuration where the discharge bias is respectively applied to the plurality of cleaning rollers 55 at different timings, for example, it is possible to suppress the high-density toners (the toners TN1 corresponding to one rotation) discharged to the conveyance belt 73 from the respective photosensitive drums 51 from overlapping with each other. For this reason, it is possible to suppress the density difference of the toners on the conveyance belt 73 and to favorably collect the toners on the conveyance belt 73 into the cleaning device 10.

In the meantime, the present invention is not limited to the above illustrative embodiment and can be used in various forms, as exemplified below. In the below descriptions, the members or steps which are substantially the same configuration as the above illustrative embodiment are denoted with the same reference numerals and the descriptions thereof are omitted.

Figure 7:
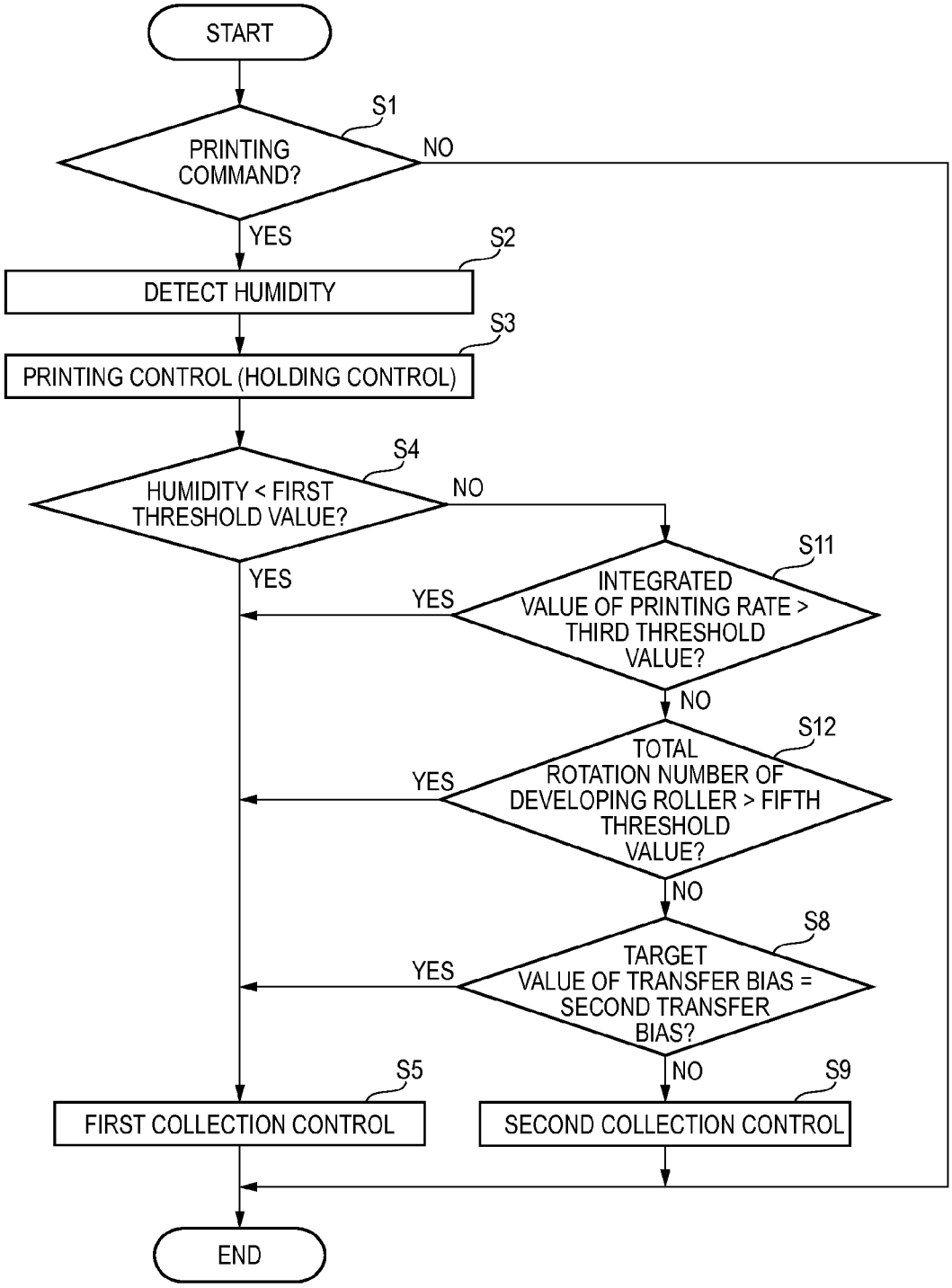
FIG. 7 is a flowchart showing a modified illustrative embodiment of the operation of the control device.

In the above illustrative embodiment, based on the number of printed sheets in the printing command, the amount of the toner to be attached to the cleaning roller 55 in the one printing command (one job) is determined. However, the present invention is not limited thereto. For example, as shown in FIG. 7, based on an integrated value of printing rates in the printing command, the amount of the toner attached to the cleaning roller 55 in the one job may be determined. That is, instead of step S6 shown in FIG. 4, a new step S11 of determining whether the integrated value of the printing rates is larger than the third threshold value may be added.

In the above illustrative embodiment, the deterioration degree of the toner is determined based on the total number of printed sheets of the developing cartridge 530. However, the present invention is not limited thereto. For example, as shown in FIG. 7, the deterioration degree of the toner may be determined based on a total rotation number of the developing roller 53. That is, instead of step S7 shown in FIG. 4, a new step S12 of determining whether the total rotation number of the developing roller 53 is larger than a sixth threshold value may be added. In the meantime, the total rotation number of the developing roller 53 is a total rotation number of the developing roller 53 up to now after the developing cartridge 530 is mounted to the apparatus main body 2, and is reset to 0 when the developing cartridge 530 is replaced.

In the above illustrative embodiment, the collection control is switched by determining the four conditions (S4, S6, S7, S8). However, the present invention is not limited thereto. For example, the collection control may be switched based on determination of only one condition. Also, the first collection control may be executed all the time without changing the collection control to one of the first collection control and the second collection control.

In the above illustrative embodiment, the discharge bias is set to the first discharge bias V1 only for the time necessary for the cleaning roller 55 to rotate one rotation. However, the present invention is not limited thereto. For example, any time may be set inasmuch as it is the time (the time equal to or longer than time necessary for the cleaning roller to rotate one rotation and equal to or shorter than a time necessary for the cleaning roller to rotate three rotations), which is necessary for the cleaning roller to rotate one to three rotations.

In the above illustrative embodiment, the cleaning roller 55 has been exemplified as the holding roller. However, the present invention is not limited thereto. For example, the holding roller may be a brush-shaped member configured to sliding-contact the photosensitive drum and to collect the toner on the photosensitive drum, the charging roller configured to contact the photosensitive drum and to charge the same, and the like.

In the above illustrative embodiment, the cleaning device 10 has been exemplified as the collection device. However, the present invention is not limited thereto. For example, the collection device may be the developing cartridge configured to contact the photosensitive drum and to collect the toner on the photosensitive drum by the developing roller, and a drum cleaning unit having a blade capable of collecting the toner on the photosensitive drum. Also, the present invention has been applied to the color printer 1. However, the present invention is not limited thereto. For example, the present invention can be also applied to the other image forming apparatus such as a monochrome printer, a copier, a complex machine and the like.

In the below, a configuration of a monochrome laser printer 101 (an example of the image forming apparatus), and a configuration of a developing cartridge 128 functioning as the collection device in the laser printer 101 are described in detail with reference to FIG. 8.

Figure 8:
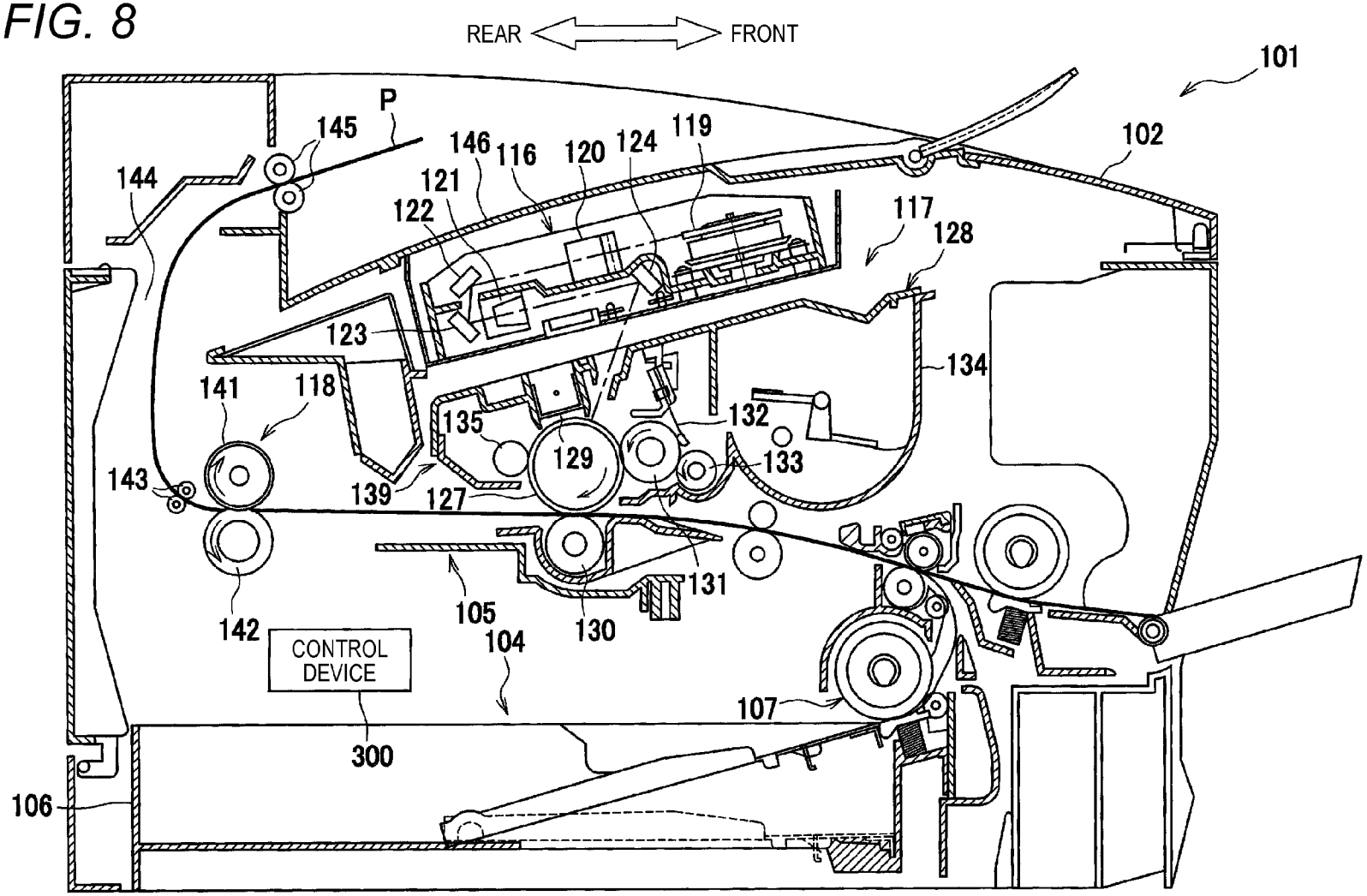
FIG. 8 shows a modified illustrative embodiment of the image forming apparatus and the collection device.

As shown in FIG. 8, the laser printer 101 of this illustrative embodiment has an apparatus main body 102, a feeder unit 104 configured to feed the sheet P, an image forming unit 105 configured to form an image on the fed sheet P and a control device 300.

The feeder unit 104 has a sheet feeding tray 106 detachably mounted to a bottom part in the apparatus main body 102 and a sheet feeding mechanism 107 configured to convey the sheet P from the sheet feeding tray 106 towards the image forming unit 105. In the feeder unit 104, the sheets P in the sheet feeding tray 106 are separated one by one by the sheet feeding mechanism 107, which is then fed to the image forming unit 105.

The image forming unit 105 has a scanner unit 116, a process cartridge 117 and a fixing device 118.

The scanner unit 116 is provided at an upper part in the apparatus main body 102, and has a laser light emitting unit (not shown), a polygon mirror 119 to be rotated, lenses 120, 121 and reflectors 122, 123, 124. In the scanner unit 116, a laser beam is illuminated onto a surface of a photosensitive drum 127 of the process cartridge 117 by high-speed scanning through a path shown with the dashed-dotted line of FIG. 8.

The process cartridge 117 is arranged below the scanner unit 116 and is detachably mounted to the apparatus main body 102. The process cartridge 117 mainly has a drum unit 139 and a developing cartridge 128 detachably mounted to the drum unit 139.

The drum unit 139 has the photosensitive drum 127, a charger 129, a transfer roller 130 and a cleaning roller 135, which is an example of the holding roller.

The developing cartridge 128 has a developing roller 131, a layer thickness regulation blade 132, a supply roller 133 and a toner hopper 134.

In the process cartridge 117, a surface of the photosensitive drum 127 charged by the charger 129 is exposed by the laser beam emitted from the scanner unit 116, so that an electrostatic latent image is formed on the photosensitive drum 127. The toner in the toner hopper 134 is supplied to the electrostatic latent image via the supply roller 133 and the developing roller 131, so that a toner image is formed on the photosensitive drum 127. After that, when the sheet P is conveyed between the photosensitive drum 127 and the transfer roller 130, the toner image on the photosensitive drum 127 is transferred to the sheet P.

The fixing device 118 has a heating roller 141 and a pressing roller 142. In the fixing device 118, while the sheet P passes between the heating roller 141 and the pressing roller 142, the toner image transferred on the sheet P is heat-fixed. Then, the sheet P is conveyed to a sheet discharge path 144 by conveyance rollers 143. In the meantime, the sheet P conveyed to the sheet discharge path 144 is discharged onto a sheet discharge tray 146 by sheet discharge rollers 145.

The control device 300 is configured to execute a holding control of applying a holding bias to the cleaning roller 135 such that the cleaning roller 135 holds the toner, and a collection control of applying a discharge bias to the cleaning roller to cause the toner held on the cleaning roller 135 to move to the photosensitive drum 127 and then to move the toner from the photosensitive drum 127 to the developing roller 131 to collect the toner into the developing cartridge 128. Specifically, the control device 300 is configured to apply a bias for moving the toner on the photosensitive drum 127 to the developing roller 131 between the photosensitive drum 127 and the developing roller 131, in the collection control.

Further, the control device 300 is configured to execute the first collection control and the second collection control in the collection control, which are the same as the above-described illustrative embodiment. That is, the control device 300 is configured to set the discharge bias to the first discharge bias after the collection control starts until the first time elapses and to switch the discharge bias from the first discharge bias to the second discharge bias after the first time elapses from the start of the collection control, in the first collection control. Also, the control device 300 is configured to set the discharge bias to the second discharge bias after the collection control starts until the collection control is finished, in the second collection control.

According to the above illustrative embodiment, the same effects as the above-described illustrative embodiment can be also accomplished in the monochrome laser printer 101.

In the above illustrative embodiment, the photosensitive drum 51 has been exemplified as the image carrier. However, the present invention is not limited thereto. For example, the image carrier may be a belt-type photosensitive member.

In the above illustrative embodiments, the sheet P has been exemplified as a transfer medium. However, the present invention is not limited thereto. For example, the transfer medium may be an intermediate transfer belt in an image forming apparatus having the intermediate transfer belt.

In the above illustrative embodiment, the transfer roller 74 has been exemplified as the transfer member. However, the present invention is not limited thereto. For example, the transfer member may be any member to which the transfer bias is applied, such as a conductive brush and a conductive plate spring.

In the above illustrative embodiment, the toner having the positive polarity has been exemplified as the developer. However, the present invention is not limited thereto. For example, the developer may be toner having a negative polarity. In the meantime, when the toner having a negative polarity is used, the holding bias, the discharge bias and the like may have an opposite polarity to the illustrative embodiment.

In the above illustrative embodiment, the conveyance belt 73 has been exemplified as the belt. However, the present invention is not limited thereto. For example, the belt may be an intermediate transfer belt.

In the above illustrative embodiment, the developing cartridge 530 has been exemplified as the developing device. However, the present invention is not limited thereto. For example, the developing device may be a process cartridge in which a developing cartridge and a drum cartridge are integrally formed.

What is claimed is:

1. An image forming apparatus comprising:

an image carrier configured to carry thereon a developer image;

a holding roller configured to hold thereon developer attached on the image carrier;

a charger different from the holding roller and configured to charge the image carrier;

a transfer member provided to face the image carrier and configured to transfer the developer image on the image carrier to a transfer medium;

a collection device configured to collect the developer on the holding roller via at least the image carrier, and a control device configured to execute a holding control while the image forming apparatus is printing an image on the transfer medium, the holding control including causing the holding roller to hold the developer by applying to the holding roller a holding bias having a polarity opposite to the developer, the control device further configured to execute a collection control of causing the developer held on the holding roller to move to the image carrier such that the collection device collects the developer via at least the image carrier, wherein the control device is further configured to:

apply to the holding roller a first discharge bias having a same polarity as the developer after the collection control starts and until a first time elapses, the first time being equal to or longer than a time necessary for the holding roller to rotate one rotation and being shorter than a time necessary for the holding roller to rotate three rotations, and apply to the holding roller a second discharge bias having a same polarity as the developer and having an absolute value larger than the first discharge bias after the first time elapses from a start of the collection control.

2. The image forming apparatus according to claim 1, wherein the first time is a time necessary for the holding roller to rotate one rotation.

3. The image forming apparatus according to claim 1, further comprising:

a humidity detection unit configured to detect humidity, wherein the control device is configured to:

when the humidity detected by the humidity detection unit is less than a first threshold value, switch a discharge bias from the first discharge bias to the second discharge bias after the collection control starts and until the collection control is finished, and when the humidity detected by the humidity detection unit is equal to or larger than the first threshold value, apply the second discharge bias to the holding roller after the collection control starts and until the collection control is finished.

4. The image forming apparatus according to claim 1, wherein the control device is configured to:

when a number of printed sheets in a printing command is larger than a second threshold value, switch a discharge bias from the first discharge bias to the second discharge bias after the collection control starts and until the collection control is finished, and when the number of printed sheets in the printing command is equal to or smaller than the second threshold value, apply the second discharge bias to the holding roller after the collection control starts and until the collection control is finished.

5. The image forming apparatus according to claim 1, wherein the control device is configured to:

when an integrated value of printing rates in a printing command is larger than a third threshold value, switch a discharge bias from the first discharge bias to the second discharge bias after the collection control starts and until the collection control is finished, and when the integrated value of printing rates in the printing command is equal to or smaller than the third threshold value, apply the second discharge bias to the holding roller after the collection control starts and until the collection control is finished.

6. The image forming apparatus according to claim 1, further comprising:

a developing device configured to accommodate therein developer so as to supply the developer to the image carrier, wherein the control device is configured to:

when a deterioration degree of the developer in the developing device is larger than a fourth threshold value, switch a discharge bias from the first discharge bias to the second discharge bias after the collection control starts and until the collection control is finished, and when the deterioration degree of the developer in the developing device is equal to or smaller than the fourth threshold value, apply the second discharge bias to the holding roller after the collection control starts and until the collection control is finished.

7. The image forming apparatus according to claim 1, wherein the control device is configured to execute:

first transfer processing of setting a target value of a transfer bias to be applied to the transfer member to a first transfer bias, and second transfer processing of setting the target value of the transfer bias to a second transfer bias having an absolute value larger than the first transfer bias, and wherein the control device is configured to:

when executing the second transfer processing, switch a discharge bias from the first discharge bias to the second discharge bias after the collection control starts and until the collection control is finished, and when executing the first transfer processing, apply the second discharge bias to the holding roller after the collection control starts and until the collection control is finished.

8. The image forming apparatus according to claim 1, wherein the image carrier, the holding roller and the transfer member are provided in plural, respectively, wherein a rotatable belt is provided between the plurality of image carriers and the plurality of transfer members with being interposed between the respective image carriers and the respective transfer members, wherein the collection device is configured to collect developer on the belt, wherein the control device is configured to:

collect the developer from the holding rollers to the collection device via the image carriers and the belt, and apply the first discharge bias or the second discharge bias to the plurality of holding rollers at a same time when starting the collection control.

9. The image forming apparatus according to claim 8, wherein a length of the belt between adjacent image carriers is larger than an outer circumference of the holding roller.

10. An image forming apparatus comprising:

an image carrier configured to carry thereon a developer image;

a holding roller configured to hold thereon developer attached on the image carrier;

a charger different from the holding roller and configured to charge the image carrier; and a control device configured to execute a holding control while the image forming apparatus is printing an image on a transfer medium, the holding control including causing the holding roller to hold the developer by applying to the holding roller a holding bias having a polarity opposite to the developer causing the holding roller to hold the developer, the control device further configured to execute a discharge control of causing the developer held on the holding roller to move to the image carrier, wherein the control device is further configured to:

apply to the holding roller a first discharge bias having a same polarity as the developer after the discharge control starts and until a first time elapses, the first time being equal to or longer than a time necessary for the holding roller to rotate one rotation, and apply to the holding roller a second discharge bias having a same polarity as the developer and having an absolute value larger than the first discharge bias after the first time elapses from a start of the discharge control.

11. The image forming apparatus according to claim 10, further comprising:

a humidity detection unit configured to detect humidity, wherein the control device is configured to:

when the humidity detected by the humidity detection unit is less than a first threshold value, switch a discharge bias from the first discharge bias to the second discharge bias after the discharge control starts and until the discharge control is finished, and when the humidity detected by the humidity detection unit is equal to or larger than the first threshold value, apply the second discharge bias to the holding roller after the discharge control starts and until the discharge control is finished.

12. The image forming apparatus according to claim 10, wherein the control device is configured to:

when a number of printed sheets in a printing command is larger than a second threshold value, switch a discharge bias from the first discharge bias to the second discharge bias after the discharge control starts and until the discharge control is finished, and when the number of printed sheets in the printing command is equal to or smaller than the second threshold value, apply the second discharge bias to the holding roller after the discharge control starts and until the discharge control is finished.

13. The image forming apparatus according to claim 10, wherein the control device is configured to:

when an integrated value of printing rates in a printing command is larger than a third threshold value, switch a discharge bias from the first discharge bias to the second discharge bias after the discharge control starts and until the discharge control is finished, and when the integrated value of printing rates in the printing command is equal to or smaller than the third threshold value, apply the second discharge bias to the holding roller after the discharge control starts and until the discharge control is finished.

14. The image forming apparatus according to claim 10, further comprising:

a developing device configured to accommodate therein developer so as to supply the developer to the image carrier, wherein the control device is configured to:

when a deterioration degree of the developer in the developing device is larger than a fourth threshold value, switch a discharge bias from the first discharge bias to the second discharge bias after the discharge control starts and until the discharge control is finished, and when the deterioration degree of the developer in the developing device is equal to or smaller than the fourth threshold value, apply the second discharge bias to the holding roller after the discharge control starts and until the discharge control is finished.

15. The image forming apparatus according to claim 10, further comprising:

a transfer member provided to face the image carrier and configured to transfer the developer image on the image carrier to a transfer medium, wherein the control device is configured to execute:

first transfer processing of setting a target value of a transfer bias to be applied to the transfer member to a first transfer bias, and second transfer processing of setting the target value of the transfer bias to a second transfer bias having an absolute value larger than the first transfer bias, and wherein the control device is configured to:

when executing the second transfer processing, switch a discharge bias from the first discharge bias to the second discharge bias after the discharge control starts and until the discharge control is finished, and when executing the first transfer processing, apply the second discharge bias to the holding roller after the discharge control starts and until the discharge control is finished.

16. The image forming apparatus according to claim 10, further comprising:

a transfer member provided to face the image carrier and configured to transfer the developer image on the image carrier to the transfer medium; and a collection device, wherein the image carrier, the holding roller and the transfer member are provided in plural, respectively, wherein a rotatable belt is provided between the plurality of image carriers and the plurality of transfer members with being interposed between the respective image carriers and the respective transfer members, wherein the collection device is provided to contact the belt and configured to collect developer on the belt, wherein the control device is configured to:

collect the developer from the holding rollers to the collection device via the image carriers and the belt, and apply the first discharge bias or the second discharge bias to the plurality of holding rollers at a same time when starting the discharge control.

17. The image forming apparatus according to claim 16, wherein a length of the belt between adjacent image carriers is larger than an outer circumference of the holding roller.

18. A control method for an image forming apparatus including an image carrier configured to carry thereon a developer image, a holding roller configured to hold thereon developer attached on the image carrier, and a charger different from the holding roller and configured to charge the image carrier, the control method comprising:

executing a holding control while the image forming apparatus is printing an image on a transfer medium, the holding control including causing the holding roller to hold the developer by applying to the holding roller a holding bias having a polarity opposite to the developer causing the holding roller to hold the developer; and executing a discharge control of causing the developer held on the holding roller to move to the image carrier, wherein the discharge control includes:

applying to the holding roller a first discharge bias having a polarity same as the developer after the discharge control starts until a first time elapses, the first time being equal to or longer than a time necessary for the holding roller to rotate one rotation; and applying to the holding roller a second discharge bias having a polarity same as the developer and having an absolute value larger than the first discharge bias after the first time elapses from a start of the discharge control.

19. The control method according to claim 18, wherein the image forming apparatus further includes a transfer member provided to face the image carrier and configured to transfer the developer image on the image carrier to the transfer medium, and a collection device, wherein the image carrier, the holding roller and the transfer member are provided in plural, respectively, wherein a rotatable belt is provided between the plurality of image carriers and the plurality of transfer members with being interposed between the respective image carriers and the respective transfer members, wherein the collection device is provided to contact the belt and configured to collect developer on the belt, wherein the discharge control includes:

causing the collection device to collect the developer from the holding rollers via the image carriers and the belt, and applying the first discharge bias or the second discharge bias to the plurality of holding rollers at a same time when starting the discharge control.

* * * * *